US011814963B2

(12) United States Patent
McMillan

(10) Patent No.: US 11,814,963 B2
(45) Date of Patent: Nov. 14, 2023

(54) SYSTEMS AND METHODS FOR A HEAT ENGINE SYSTEM

(71) Applicant: Argyle Earth, Inc, San Jose, CA (US)

(72) Inventor: Christopher McMillan, San Jose, CA (US)

(73) Assignee: ARGYLE EARTH, INC, San Jose, CA (US)

( * ) Notice: Subject to any disclaimer, the term of this patent is extended or adjusted under 35 U.S.C. 154(b) by 0 days.

(21) Appl. No.: 17/844,824

(22) Filed: Jun. 21, 2022

(65) Prior Publication Data

US 2023/0287793 A1 Sep. 14, 2023

Related U.S. Application Data

(60) Provisional application No. 63/319,551, filed on Mar. 14, 2022.

(51) Int. Cl.

| | |
|---|---|
| ***F01C 20/24*** | (2006.01) |
| ***F01K 23/10*** | (2006.01) |
| ***F01C 21/18*** | (2006.01) |
| ***F01C 21/06*** | (2006.01) |

(52) U.S. Cl.
CPC ..... *F01C 20/24* (2013.01); *F01C 21/06* (2013.01); *F01C 21/18* (2013.01); *F01K 23/101* (2013.01)

(58) Field of Classification Search
CPC ..... F01C 20/24; F01C 21/06; F01C 21/18
USPC ..... 418/83
See application file for complete search history.

(56) References Cited

U.S. PATENT DOCUMENTS

| | | | |
|---|---|---|---|
| 4,033,141 | A | 7/1977 | Gustafsson |
| 4,306,416 | A | 12/1981 | Iozzi |
| 7,726,129 | B2 | 6/2010 | Driver |
| 7,971,424 | B2 | 7/2011 | Masada |
| 8,966,902 | B2 | 3/2015 | Stiesdal |
| 9,038,390 | B1 | 5/2015 | Kreuger |
| 9,631,845 | B2 | 4/2017 | Sakamoto et al. |
| 9,869,495 | B2 | 1/2018 | Gill |

(Continued)

FOREIGN PATENT DOCUMENTS

| | | |
|---|---|---|
| WO | 17171678 | 10/2017 |

OTHER PUBLICATIONS

International Search Report and Written Opinion of PCT/US2023/014954, dated Sep. 5, 2023, 13 pages.

*Primary Examiner* — J. Todd Newton
(74) *Attorney, Agent, or Firm* — Tarolli, Sundheim, Covell & Tummino, LLP

(57) ABSTRACT

Systems and methods for a heat engine system are described. In one embodiment, a system comprises a heat engine compressor, a heat exchanger, and a heat engine expander. The system comprises a partial state condenser in fluid communication with the heat engine expander. The partial state condenser includes a sense reservoir to hold the working fluid, a reservoir sensor to sense an electrical property of the working fluid, and a reservoir valve. The reservoir valve is in fluid communication with the sense reservoir, the heat engine compressor, and a heat engine condenser. The system comprises a processor to execute instructions to determine a specific energy of working fluid based on the electrical property of the working fluid and control the reservoir valve based on the specific energy to maintain a two-phase saturated state point within the partial state condenser based on the electrical property.

19 Claims, 10 Drawing Sheets

(56) References Cited

U.S. PATENT DOCUMENTS

| | | | | |
|---|---|---|---|---|
| 11,041,637 | B2 | 6/2021 | Walker | |
| 2008/0289334 | A1* | 11/2008 | Orosz | F03G 6/067 60/329 |
| 2009/0151356 | A1* | 6/2009 | Ast | F01K 13/02 60/660 |
| 2010/0287934 | A1 | 11/2010 | Glynn et al. | |
| 2016/0201520 | A1* | 7/2016 | Zhou | B60R 16/08 60/645 |
| 2019/0170436 | A1* | 6/2019 | De | F25J 3/062 |
| 2020/0284148 | A1 | 9/2020 | Binder et al. | |
| 2022/0065137 | A1* | 3/2022 | Freedman | F03B 11/004 |

* cited by examiner

SYSTEMS AND METHODS FOR A HEAT ENGINE SYSTEM

BACKGROUND

A heat engine is a system that converts heat to mechanical energy, which can then be used to do mechanical work. It does this by bringing a working fluid from a higher state temperature to a lower state temperature. The working fluid generates work in the working body of the engine while transferring heat to the colder sink until it reaches a low temperature state. During this process some of the thermal energy is converted into work by exploiting the properties of the working substance.

SUMMARY

In one embodiment, a heat engine system is provided. The imbalanced heat engine system comprises a heat engine compressor that circulates a working fluid through the imbalanced heat engine system. The heat engine system further comprises a heat exchanger fluidically downstream from and in fluid communication with the heat engine compressor. The heat engine system also comprises a heat engine expander fluidically downstream from and in fluid communication with the heat exchanger. The heat engine expander includes a heat engine expander inlet port. The heat engine system yet further comprises a partial state condenser fluidically downstream from and in fluid communication with the heat engine expander. The partial state condenser includes a sense reservoir holds the working fluid, a reservoir sensor senses an electrical property of the working fluid, and a reservoir valve. The reservoir valve that is a three-way valve in fluid communication with the sense reservoir, the heat engine expander, and a heat engine condenser. The heat engine system comprises a processor configured to execute instructions to determine a specific energy of the working fluid based on an electrical property of the working fluid and control the reservoir valve based on the specific energy of the working fluid to maintain a two-phase saturated state point within the partial state condenser based on the electrical property.

In one embodiment, a heat engine system is provided. The heat engine system comprises a heat engine compressor circulates working fluid through the imbalanced heat engine. The heat engine system further comprises a heat exchanger fluidically downstream from and in fluid communication with the heat engine compressor. The heat engine system also comprises a heat engine expander fluidically downstream from and in fluid communication with the heat exchanger. The heat engine expander includes a heat engine expander inlet port. The heat engine system yet further comprises a partial state condenser fluidically downstream from and in fluid communication with the heat engine expander. The partial state condenser includes a sense reservoir holds the working fluid, a reservoir sensor senses an electrical property of the working fluid, and a reservoir valve. The reservoir valve that is a three-way valve in fluid communication with the sense reservoir, the heat engine expander, and a heat engine condenser. The heat engine system comprises a processor executes instructions to determine a specific energy of the working fluid based on an electrical property of the working fluid, determine specific energy in the sense reservoir based on the specific energy of the working fluid, and control the reservoir valve to cause working fluid to be selectively passed to the heat engine condenser based on the specific energy to maintain a controlled saturation state that is above ambient pressure.

In one embodiment, a method for a heat engine system is provided. The method includes providing a chamber that receives at least one set of condenser coils and also at least one set of evaporator coils. The at least one set of evaporator coils is disposed in a first airflow zone of the chamber and the at least one set of condenser coils is disposed in a second airflow zone of the chamber. The first airflow zone and the second airflow zone are in fluid communication with one another. The method also includes operating a fan to produce an airflow through the chamber. The method further includes passing the airflow from the fan through the first airflow zone. The at least one set of evaporator coils defines a first fluid loop for a first working fluid. The method yet further includes passing the airflow from the first airflow zone to the second airflow zone. The at least one set of condenser coils defines a second fluid loop for a second working fluid, the second fluid loop being fluidically isolated from the first fluid loop.

DETAILED DESCRIPTION

Figure 1:
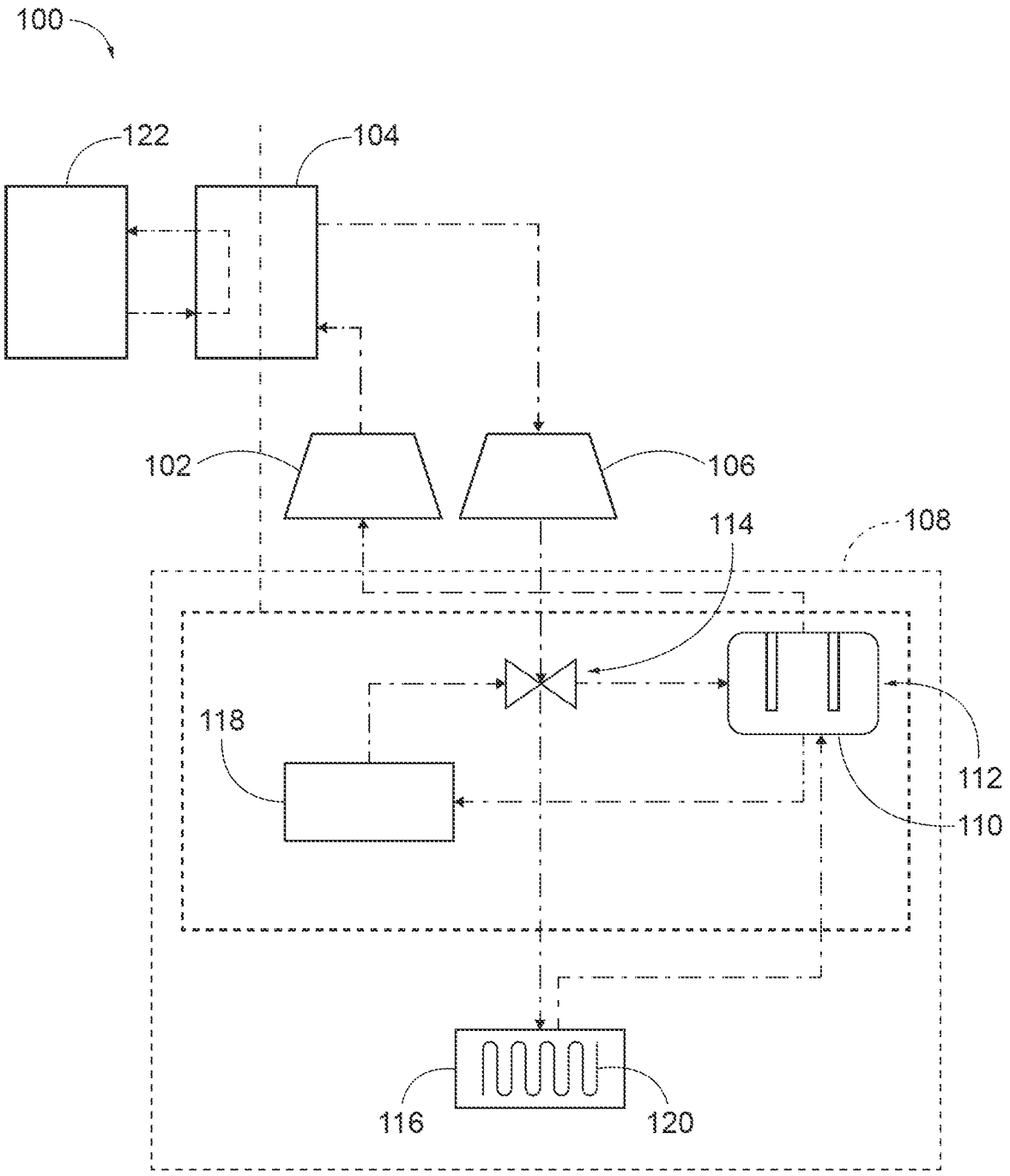
FIG. 1 is an exemplary component diagram for an operating environment of a heat engine system, according to one embodiment.

The systems and methods described herein are directed to an imbalanced heat engine system. The imbalanced heat engine system may include a heat engine that captures heat from a localized area (e.g., inside a building) and converts that heat to electricity. Built-in sensors allow the imbalanced heat engine system to tune itself to changes in the environment to maintain optimal operation. The generator can be deployed in commercial, industrial and residential applications as portable backup power or grid-tied primary power for peak shaving or continuous onsite power generation needs. Accordingly, the imbalanced heat engine system described herein offers a reliable backup power alternative, and also derives this power from non-fossil fuel energy sources. The imbalanced heat engine system, as will be described, may be used in a number of embodiments, including as an electric generator that recycles heat from the environment and converts that heat to electricity, providing clean, renewable backup power. In this manner, the systems and methods described herein provide a responsive heat engine that can manipulate the thermodynamic cycle to reduce energy losses throughout the cycle, resulting in a favorable work output.

In some embodiments, the imbalanced heat engine system may include a heat pump and a heat engine arranged such that both sides are thermally coupled to minimize energy losses from one to the other. The heat pump may create a temperature differential that causes heat to be absorbed into the heat engine, providing a continuous energy input, while the heat engine utilizes a feedback control system that manipulates the thermodynamic cycle to remain in the optimal saturation state to generate mechanical work that can be converted to electricity. In some embodiments, a partial state condenser may include a three-way valve that selectively routes working fluid in the imbalanced heat engine based on an electrical property of the working fluid. This reduces the loss of heat energy during the recovery phase of the cycle, resulting in more energy being preserved and converted to work output.

Definitions

The following includes definitions of selected terms employed herein. The definitions include various examples and/or forms of components that fall within the scope of a term and that may be used for implementation. The examples are not intended to be limiting. Furthermore, the components discussed herein, may be combined, omitted, or organized with other components or into different architectures.

"Bus," as used herein, refers to an interconnected architecture that is operably connected to other computer components inside a computer or between computers. The bus may transfer data between the computer components. The bus may be a memory bus, a memory processor, a peripheral bus, an external bus, a crossbar switch, and/or a local bus, among others. The bus may also interconnect components using protocols such as Media Oriented Systems Transport (MOST), Controller Area network (CAN), Local Interconnect network (LIN), among others.

"Component," as used herein, refers to a computer-related entity (e.g., hardware, firmware, instructions in execution, combinations thereof). Computer components may include, for example, a process running on a processor, a processor, an object, an executable, a thread of execution, and a computer. A computer component(s) may reside within a process and/or thread. A computer component may be localized on one computer and/or may be distributed between multiple computers.

"Computer communication," as used herein, refers to a communication between two or more communicating devices (e.g., computer, personal digital assistant, cellular telephone, network device, computing device, infrastructure device, roadside equipment) and may be, for example, a network transfer, a data transfer, a file transfer, an applet transfer, an email, a hypertext transfer protocol (HTTP) transfer, and so on. A computer communication may occur across any type of wired or wireless system and/or network having any type of configuration, for example, a local area network (LAN), a personal area network (PAN), a wireless personal area network (WPAN), a wireless network (WAN), a wide area network (WAN), a metropolitan area network (MAN), a virtual private network (VPN), a cellular network, a token ring network, a point-to-point network, an ad hoc network, a mobile ad hoc network, Computer communication may utilize any type of wired, wireless, or network communication protocol including, but not limited to, Ethernet (e.g., IEEE 802.3), WiFi (e.g., IEEE 802.11), communications access for land mobiles (CALM), WiMax, Bluetooth, Zigbee, ultra-wideband (UWAB), multiple-input and multiple-output (MIMO), telecommunications and/or cellular network communication (e.g., SMS, MMS, 3G, 4G, LTE, 5G, GSM, CDMA, WAVE), satellite, dedicated short range communication (DSRC), among others.

"Communication interface" as used herein may include input and/or output devices for receiving input and/or devices for outputting data. The input and/or output may be for controlling different features of a system, which include various components, systems, and subsystems. Specifically, the term "input device" includes, but is not limited to: keyboard, microphones, pointing and selection devices, cameras, imaging devices, video cards, displays, push buttons, rotary knobs, and the like. The term "input device" additionally includes graphical input controls that take place within a user interface which may be displayed by various types of mechanisms such as software and hardware-based controls, interfaces, touch screens, touch pads or plug and play devices. An "output device" includes, but is not limited to, display devices, and other devices for outputting information and functions.

"Computer-readable medium," as used herein, refers to a non-transitory medium that stores instructions and/or data. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Common forms of a computer-readable medium may include, but are not limited to, a flexible disk, a hard disk, a magnetic tape, other magnetic medium, an ASIC, optical medium, a RAM, a ROM, a memory chip or card, a memory stick, and other media from which a computer, a processor or other electronic device may read.

"Database," as used herein, is used to refer to a table. In other examples, "database" may be used to refer to a set of tables. In still other examples, "database" may refer to a set of data stores and methods for accessing and/or manipulating those data stores. In one embodiment, a database may be stored, for example, at a disk, data store, and/or a memory. A database may be stored locally or remotely and accessed via a network.

"Data store," as used herein may be, for example, a magnetic disk drive, a solid-state disk drive, a floppy disk drive, a tape drive, a Zip drive, a flash memory card, and/or a memory stick. Furthermore, the disk may be a CD-ROM (compact disk ROM), a CD recordable drive (CD-R drive), a CD rewritable drive (CD-RW drive), and/or a digital video ROM drive (DVD ROM). The disk may store an operating system that controls or allocates resources of a computing device.

"Display," as used herein may include, but is not limited to, LED display panels, LCD display panels, CRT display, touch screen displays, among others, that often display information. The display may receive input (e.g., touch input, keyboard input, input from various other input devices, etc.) from a user. The display may be accessible through various devices, for example, though a remote system. The display may also be physically located on a portable device, mobility device, or host.

"Logic circuitry," as used herein, includes, but is not limited to, hardware, firmware, a non-transitory computer readable medium that stores instructions, instructions in execution on a machine, and/or to cause (e.g., execute) an action(s) from another logic circuitry, module, method and/or system. Logic circuitry may include and/or be a part of a processor controlled by an algorithm, a discrete logic (e.g., ASIC), an analog circuit, a digital circuit, a programmed logic device, a memory device containing instructions, and so on. Logic may include one or more gates, combinations of gates, or other circuit components. Where multiple logics are described, it may be possible to incorporate the multiple logics into one physical logic. Similarly, where a single logic is described, it may be possible to distribute that single logic between multiple physical logics.

"Memory," as used herein may include volatile memory and/or nonvolatile memory. Non-volatile memory may include, for example, ROM (read only memory), PROM (programmable read only memory), EPROM (erasable PROM), and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory may store an operating system that controls or allocates resources of a computing device.

"Module," as used herein, includes, but is not limited to, non-transitory computer readable medium that stores instructions, instructions in execution on a machine, hardware, firmware, software in execution on a machine, and/or combinations of each to perform a function(s) or an action(s), and/or to cause a function or action from another module, method, and/or system. A module may also include logic, a software-controlled microprocessor, a discrete logic circuit, an analog circuit, a digital circuit, a programmed logic device, a memory device containing executing instructions, logic gates, a combination of gates, and/or other circuit components. Multiple modules may be combined into one module and single modules may be distributed among multiple modules.

"Operable connection," or a connection by which entities are "operably connected," is one in which signals, physical communications, and/or logical communications may be sent and/or received. An operable connection may include a wireless interface, firmware interface, a physical interface, a data interface, and/or an electrical interface.

"Processor," as used herein, processes signals and performs general computing and arithmetic functions. Signals processed by the processor may include digital signals, data signals, computer instructions, processor instructions, messages, a bit, a bit stream, that may be received, transmitted and/or detected. Generally, the processor may be a variety of various processors including multiple single and multicore processors and co-processors and other multiple single and multicore processor and co-processor architectures. The processor may include logic circuitry to execute actions and/or algorithms or be an analog circuit.

"Working fluid," as used herein, is a substance for transferring energy throughout a thermodynamic system, such as a heat engine or a heat pump. The selection of the working fluid may be based on the amount of energy absorbed favoring a greater work output as the fluid progresses through the thermodynamic system. The working fluid may include, for example, water, pentane, toluene, chlorofluorocarbons, hydrochlorofluorocarbons, hydrofluoroolefins, fluorocarbons, propane, butane, isobutane, ammonia, sulfur dioxide. The working fluid may be selected based on a higher energy enthalpy state at 100% vapor quality operating point. The working fluid may also be selected based on the entropy difference of the working fluid from a liquid state to a gas state.

I. Systems and Methods Overview

Referring to FIG. 1, an imbalanced heat engine system 100 may include a heat engine compressor 102. The heat engine compressor 102 circulates working fluid through the heat engine system 100. The heat engine compressor 102 may be, for example, a positive displacement compressor or a dynamic compressor. In an embodiment in which the heat engine compressor 102 is a positive displacement compressor, the heat engine compressor 102 may increase the pressure of the working fluid by reducing the volume of the working fluid with, for example, a piston, rotary vane, etc. In an embodiment in which the heat engine compressor 102 is a dynamic compressor, the heat engine compressor 102 may increase the pressure of the working fluid with a continuous transfer of angular momentum to the working fluid with, for example, a rotating member. In some embodiments, the heat engine compressor 102 may be a two-phase fluid compressor. The working fluid being compressed may partially liquid and partially gaseous.

The heat engine system 100 may include a heat exchanger 104 fluidically downstream and in fluid communication with the heat engine compressor 102. The heat exchanger 104 may transfer energy from an external heat source 122 into the working fluid of the heat engine system 100 to work a generator, for example. The external heat source 122 may be a heat pump, waste stream, etc. The heat exchanger 104 may be further configured to reduce a pressure drop during the energy transfer. Reducing the pressure drop may minimize overall inefficiencies. The heat exchanger 104 may be in heat communication (i.e., fluid communication) with a heat pump as will be discussed in greater detail below.

The heat engine system 100 includes a heat engine expander 106 fluidically downstream and in fluid communication with the heat exchanger 104. The heat engine expander 106 extracts energy from the working fluid in the form of work, which can then be converted to other types of energy. The heat engine expander 106 includes a number of surfaces in contact with the working fluid. To reduce energy leaking to the ambient environment, the number of surfaces of heat engine expander 106 may be coated with a thermally insulative coating to reduce heat conduction.

The heat engine system 100 includes a partial state condenser 108 fluidically downstream and in fluid communication with the heat engine expander 106. The partial state condenser 108 is configured to regulate the working fluid in a saturation state. In the saturation state the working fluid has more energy than that of the working fluid in a liquid state, but the working fluid does not have enough energy to be fully in a vapor state. To regulate the saturation state of the working fluid, the partial state condenser 108 may include a feedback loop.

The feedback loop of the partial state condenser 108 may include a sense reservoir 110 configured to hold the working fluid, a reservoir sensor 112 configured to sense an electrical property of the working fluid, and a reservoir valve 114 that is a three-way valve in fluid communication with the heat engine expander 106, the sense reservoir 110, and a heat engine condenser 116. A first portion of the working fluid is received at the sense reservoir 110. The sense reservoir 110 includes the reservoir sensor 112. The reservoir sensor 112 is configured to measure an electrical property of the working fluid. In some embodiments, the electrical property may be the relative dielectric permittivity of the working fluid. The relative dielectric permittivity can be used to determine vapor quality. The vapor quality is the mass fraction of the working fluid that is vapor. For example, if the vapor quality of working fluid is 100%, then the working fluid is a saturated vapor, and if the working fluid is 0%, then the working fluid is a saturated liquid. The vapor quality may be used to determine a thermodynamic state of the working fluid in the sense reservoir 110.

The thermodynamic parameter is indicative of the energy of the working fluid in the sense reservoir 110. The thermodynamic parameter may be the specific energy or the specific enthalpy of the working fluid. The specific energy is the energy per unit mass of the working fluid. For example, the relative dielectric permittivity may be used to determine the specific energy of the working fluid. Based on the thermodynamic parameter, the reservoir valve 114 is used to regulate the flow of the working fluid from the heat engine expander 106 to either the sense reservoir 110 or the heat engine condenser 116. Accordingly, the thermodynamic parameter may be determined based on the fluid parameters, such as the electrical property, of the working fluid.

The heat engine condenser 116 is fluidically downstream and in fluid communication with the reservoir valve 114 and the sense reservoir 110. The heat engine condenser 116 includes at least one set of condenser coils 120. The heat engine condenser 116 accepts the working fluid in an energized state (e.g., heated, saturated state, vapor state) and rejects the energy of the working fluid to a cooler substance, such as ambient air. As energy is removed from the working fluid, the working fluid condenses, and the working fluid is drained as condensate to the sense reservoir 110.

The reservoir sensor 112 may operate a sense controller 118 using an analog circuit. In another embodiment, the reservoir sensor 112 may be configured for computer communication with the sense controller 118. For example, the sense controller 118 may operate in a computer environment, such as the operating environment 200 or as the computing device 204 and/or the operational systems 206.

Figure 2:
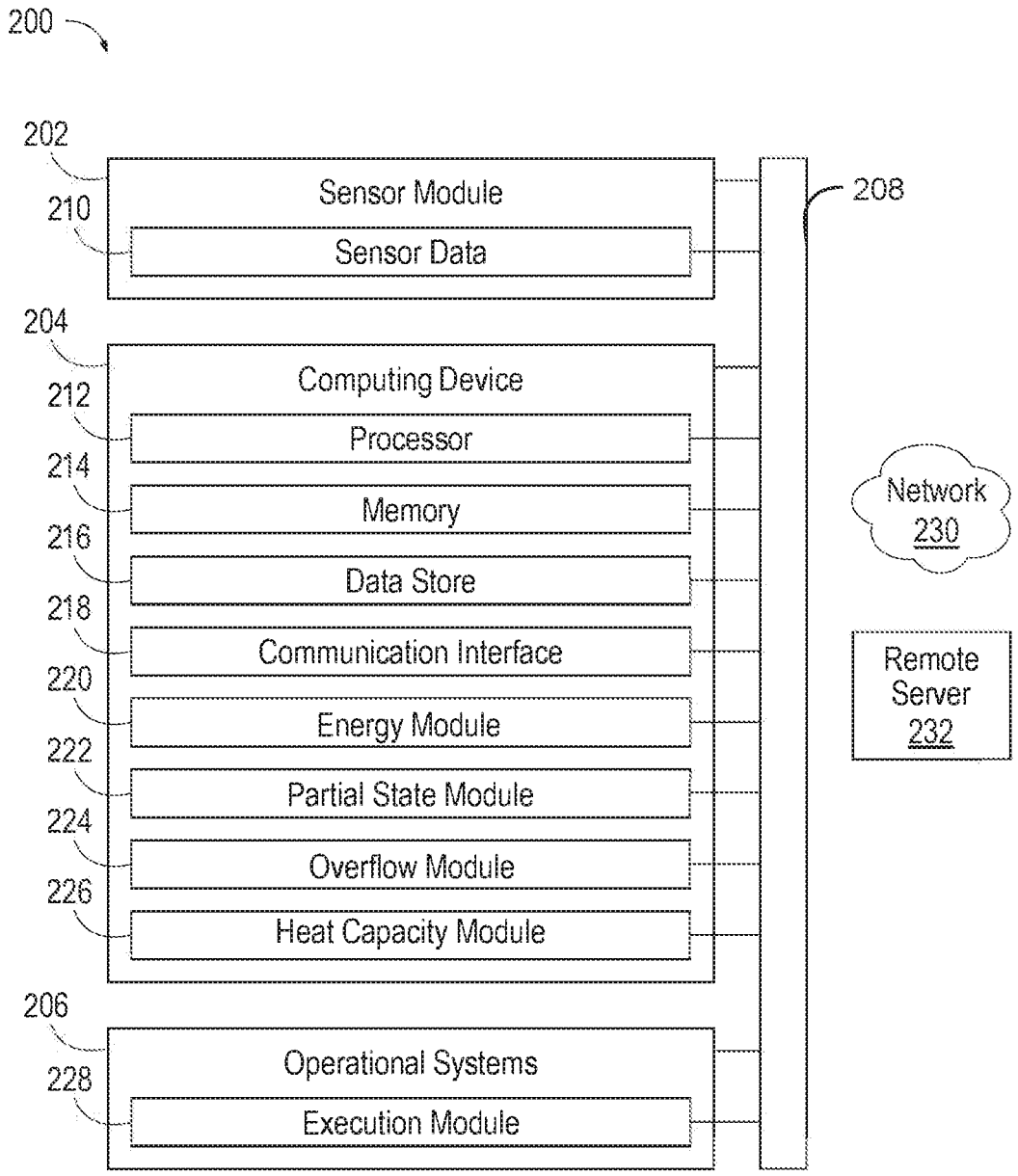
FIG. 2 is an exemplary component diagram for a computer operating environment of a heat engine system, according to one embodiment.

Turning to FIG. 2, an exemplary component diagram for a computer operating environment of an imbalanced heat engine system 100 is shown. The operating environment 200 includes a sensor module 202, the computing device 204, and operational systems 206 interconnected by a bus 208. The components of the operating environment 200, as well as the components of other systems, hardware architectures, and software architectures discussed herein, may be combined, omitted, or organized into different architectures for various embodiments. The computing device 204 may be implemented with a component of the heat engine system 100, such as the sense controller 118, or may be remotely stored.

The sensor module 202 may be implemented as a part of the reservoir sensor 112. In another embodiment, the sensor module 202 may be remotely stored and receive the sensor data 210 from the reservoir sensor 112 via a network (e.g., a network 230). The components and functions of the computing device 204 may be implemented with other devices (e.g., a portable device), a remote server 232, or another device connected via the network (e.g., a network 230).

The sensor module 202 may be capable of providing wired or wireless computer communications utilizing various protocols to send/receive electronic signals internally to/from components of the heat engine system 100, such as the reservoir sensor 112, or the operating environment 200. The sensor data 210 may include one or more fluid properties of the working fluid. The fluid properties may include electrical properties (e.g., capacitance, dielectric permittivity, resistance, etc.) and/or mechanical properties (e.g., temperature, pressure, etc.). Additionally, the computing device 204 may be operably connected for internal computer communication via the bus 208 (e.g., a Controller Area Network (CAN) or a Local Interconnect Network (LIN) protocol bus) to facilitate data input and output between the computing device 204 and the components of the operating environment 200.

The computing device 204 may include a processor 212, a memory 214, a data store 216, and a communication interface 218, which are each operably connected for computer communication via a bus 208 and/or other wired and wireless technologies. The communication interface 218 provides software and hardware to facilitate data input and output between the components of the computing device 204 and other components, networks, and data sources, which will be described herein. Additionally, the computing device 204 may include a number of modules facilitated by the components of the operating environment 200. The modules may include an energy module 220, a partial state module 222, an overflow module 224, and a heat capacity module 226.

The computing device 204 may be operably connected for computer communication (e.g., via the bus 208 and/or the communication interface 218) to one or more operational systems 206. The operational systems 206 may be implemented by the processor 212. The operational systems 206 may include, but are not limited to, any automatic or manual systems that may be used to enhance the heat engine system 100, operation, and/or safety. The operational systems 206 include an execution module 228. The execution module 228 monitors, analyses, and/or operates the heat engine system 100, to some degree. For example, the execution module 228 may store, calculate, and provide operation information and facilitate features like energy production and fluid flow among others.

The operational systems 206 may also include and/or are operably connected for computer communication to the sensor module 202. For example, one or more sensors associated with sensor module 202, such as the reservoir sensor 112, may be incorporated with execution module 228 to monitor characteristics of the environment and the working fluid. The execution module 228 may receive sensor data 210 from the sensor module 202 to modify a valve, such as the reservoir valve 114, or inlet and outlet valves, such as the reservoir inlet valve 408 and the reservoir outlet valve 410 of the pressure balancer shown in FIG. 4. The execution module 228 may modify the valves, inlet, and/or outlets to an open condition, partial open condition, or closed condition to regulate the output state of the working fluid. The modifications may be controlled to maintain the optimal saturation state of the working fluid based on the sensor data 210, such as an electrical property of the working fluid sensed by the reservoir sensor 112 and received by the sensor module 202. In some embodiments, the execution module 228 may be a Proportional, Integral, Derivative (PID) controller. The operational systems 206 may dependent on the implementation.

The sensor module 202, the computing device 204, and/or the operational systems 206 are also operatively connected for computer communication to the network 230. The network 230 is, for example, a data network, the Internet, a wide area network (WAN) or a local area (LAN) network. The network 230 serves as a communication medium to various remote devices (e.g., databases, web servers, remote servers, application servers, intermediary servers, client machines, other portable devices).

A. A Heat Engine Having a Partial State Condenser

Figure 3:
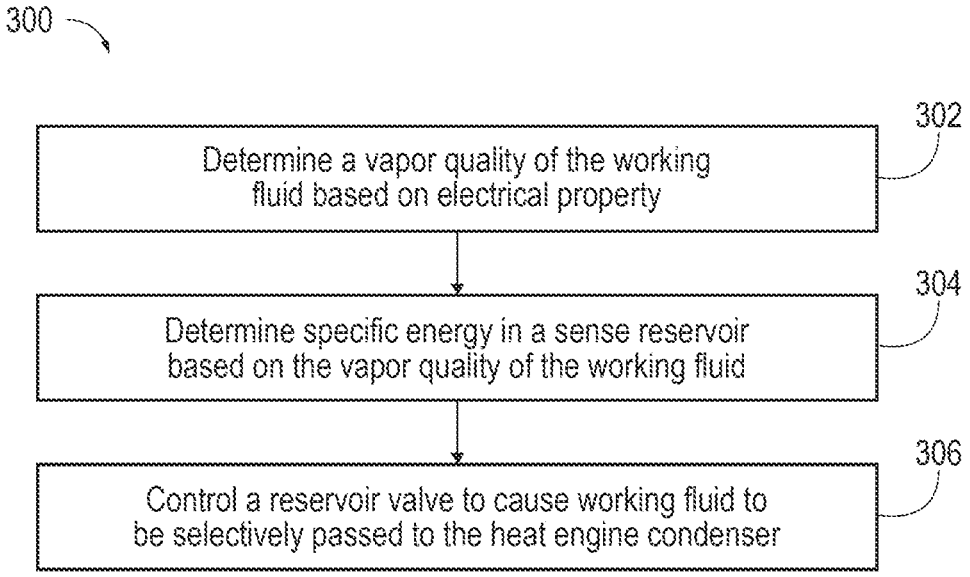
FIG. 3 is an exemplary process flow of a method for operation of a heat engine system, according to one embodiment.

Referring now to FIG. 3, a method 300 for the operation of an imbalanced heat engine system will now be described according to an exemplary embodiment. FIG. 3 will also be described with reference to FIGS. 1, 2, and 4-10. For simplicity, the method 300 will be described as a sequence of blocks, but it is understood that the blocks of the method 300 may be organized into different architectures, elements, stages, and/or processes.

At block 302, the method 300 includes the energy module 220 determining a vapor quality of the working fluid based on the electrical property of the working fluid. The vapor quality may be measured as a percentage. For example, the energy module 220 may be determined as a mass of the working fluid in the vapor state relative to the total mass of the working fluid. Because working fluids behave differently to changing electric fields due to their unique elemental make-up, the reservoir sensor 112 may sense the relative dielectric permittivity of the working fluid. Additionally or alternatively, the reservoir sensor 112 may measure other electrical properties of the working fluid (e.g., capacitance, relative dielectric permittivity, resistance, etc.) and/or mechanical properties (e.g., temperature, pressure, etc.).

The reservoir sensor 112 may be positioned within the sense reservoir 110. In one embodiment, the reservoir sensor 112 may include electrodes that are electrically isolated from each other within the sense reservoir 110. For example, the sense reservoir 110 may include the reservoir sensor 112 as two electrodes. The distance between the electrodes and the length of the electrodes may be based on the size of the sense reservoir 110.

The sensor module 202 may receive the electrical properties and/or mechanical properties of the working fluid as sensor data 210. The energy module 220 may determine the vapor quality and/or a thermodynamic property of the working fluid based on the sensor data 210. For example, the energy module 220 may determine the specific energy of the working fluid based on the electrical properties of the working fluid, such as the relative dielectric permittivity of the working fluid. For example, the energy module 220 may determine the mass of working fluid in the sense reservoir 110 based on the electrical property of the working fluid. The energy module 220 may then determine a density of the working fluid based on the mass of the working fluid in the sense reservoir 110.

At block 304, the method 300 includes the partial state module 222 determining specific energy in the sense reservoir 110 based on the vapor quality of the working fluid. The balanced flow of working fluid (matter) and energy is important for the partial state condenser 108 during stable operation of the heat engine system 100 to guard against excess fluid, excess heat, or over-extraction of heat.

If the sense reservoir 110 has a starting energy level of $E_{SR,0}$ and heat in the partial state condenser 108 is gained or lost to the ambient environment, the partial state module 222 may determine a saturation point at which the energy state of a first portion of the working fluid is equal to energy state of a second portion of the working fluid. The partial state module 222 may determine the energy in the sense reservoir 110 at a given time, as follows:

$$E_{SR}(t) = E_{SR,0} - \int_0^{t'} P(t)_{SR,out} \cdot dt + \int_0^{t'} P(t)_{SR,in} \cdot dt$$

where $E_{SR}$ is the total energy in the sense reservoir 110, $E_{SR,0}$ is the total energy in the sense reservoir 110 at a first time, $P(t)_{SR,out}$ is the energy flowing out of the sense reservoir 110 per unit time, and $P(t)_{SR,in}$ is the energy flowing into the sense reservoir 110 per unit time. In particular, $P(t)_{SR,out}$ may be given as $$P(t)_{SR,out}=H_{SR,out}\cdot m=H_{out}\cdot m$$

where m is the mass flow rate through the sense reservoir 110, $H_{SR,out}$ is the specific enthalpy of the working fluid flowing out of the sense reservoir 110, and $H_{out}$ is the specific enthalpy of the working fluid flowing out of the partial state condenser 108.

The saturation point may be given as a target energy value given by:

$$P(t)_{SR,in}=m\cdot(H_{SR,liq}\cdot(1-x(t))+H_{SR,vap}\cdot x(t))$$

where $H_{SR,liq}$ is the enthalpy of a liquid portion of the working fluid operating at the saturation point, $H_{SR,vap}$ is the enthalpy of a vapor portion of the working fluid operating at the saturation point, and $\eta(t)$ is the specific energy of the working fluid as determined by the energy module 220. At the saturation point, the working fluid is in the saturation state when the working fluid has more energy than that of the working fluid in a liquid state but not enough energy to be in a fully vapor state. In some embodiments, the saturation point may be a range of values. Accordingly, the partial state module 222 may determine the specific energy of the sense reservoir 110 and compare the determined specific energy to the saturation point to calculate a difference. The difference in the specific energy may be an absolute value or a difference in the specific energy may be based on the minima or the maxima of the range of values of the saturation point.

At block 306, the method 300 includes the execution module 228 controlling the reservoir valve 114 to cause working fluid to be selectively passed to the heat engine condenser 116 based on the specific energy required to maintain a controlled saturation state that is different than the ambient pressure in the partial state condenser 108. For example, the execution module 228 may control the reservoir valve 114 to cause working fluid to be selectively passed to the heat engine condenser 116 to maintain a controlled saturation state that is above the ambient pressure in the partial state condenser 108. In this manner, the reservoir valve 114 may control the flow of the working fluid until the specific energy satisfies the saturation point. In particular, the execution module 228 may control the reservoir valve 114 to allow a first portion of the working fluid to flow to the heat engine condenser 116 and a second portion of the working fluid to bypass the heat engine condenser 116. Controlling the reservoir valve 114 to cause the second portion of the working fluid to bypass the heat engine condenser 116 allows some energy of the working fluid to remain in the partial state condenser 108, thereby bringing the working fluid back to a saturated state.

The electrical property will change as the portions of the working fluid are routed to either the heat engine condenser 116 or the sense reservoir 110 through the reservoir valve 114. The execution module 228 may alter the flow through the reservoir valve 114 in real-time based the proportion of the determined specific energy relative to the saturation point, the sum of all error values since measurements began, and the change in the error value since the previous measurement. Thus, execution module 228 can quickly adapt to current changes, anticipate future changes based on previous state measurements, and compensate for unexpected changes thereby forming a feedback loop. The behavior for the feedback loop in the partial state condenser 108 may be represented as:

$$x(t) = \left(k_i \cdot \int \in (t) \cdot dt + k_p \cdot \epsilon(t) + k_d \cdot \frac{d_{\in}(t)}{dt}\right)$$

Accordingly, the amount of the second portion of the working fluid can be determined to bypass the heat engine condenser 116, so that the working fluid flowing to heat engine compressor 102 is at the saturation point.

Figure 4:
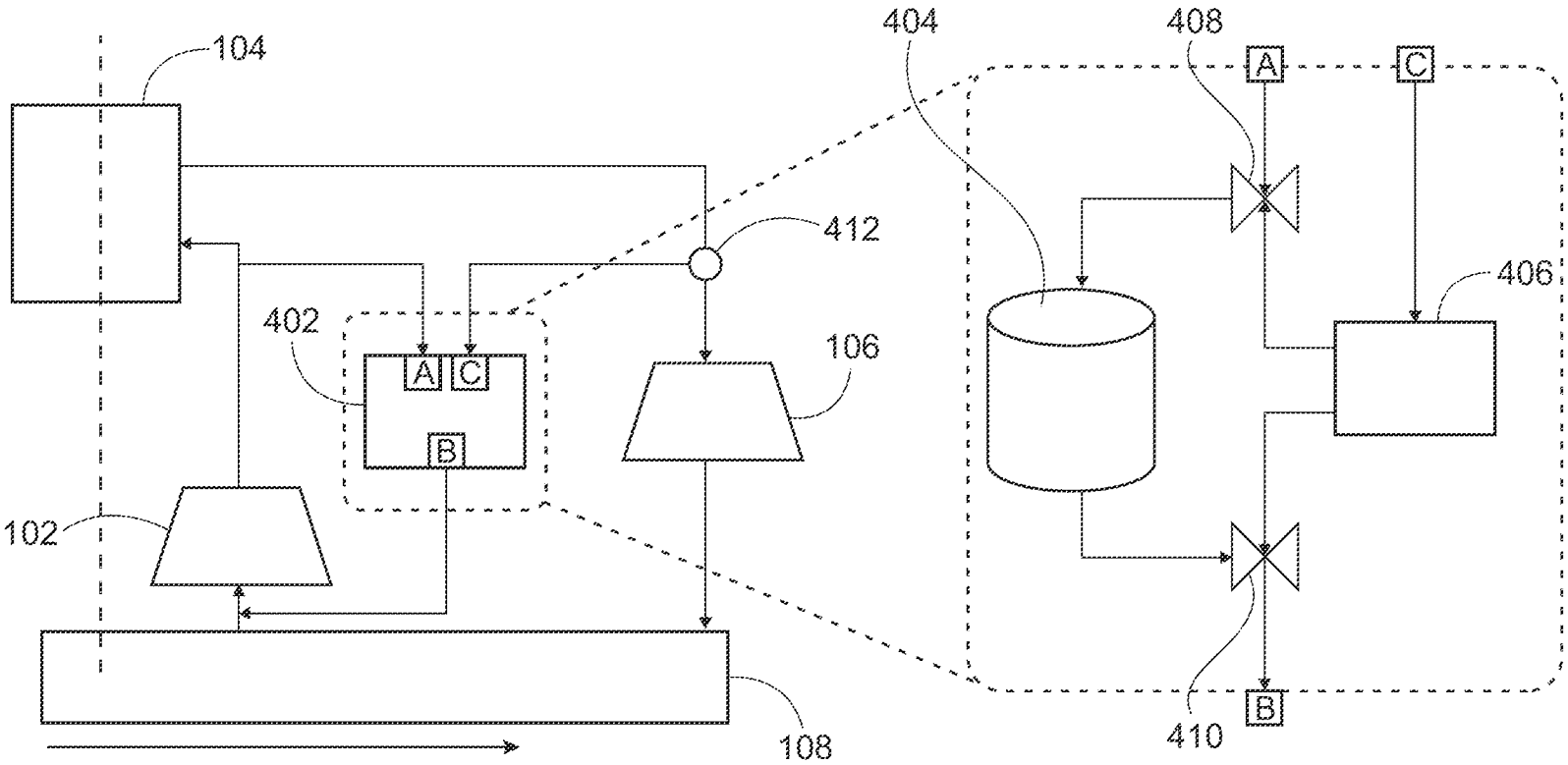
FIG. 4 is an exemplary component diagram of a heat engine system with a pressure balancer, according to one embodiment.

FIG. 4 is an exemplary component diagram for a pressure balancer 402, according to one embodiment. The pressure balancer 402 may be included in the heat engine system 100 to help regulate the pressure of the working fluid entering the heat engine expander 106, thereby regulating the specific operating point of the heat engine expander 106. The pressure balancer 402 may be used in parallel with the heat engine compressor 102. The pressure balancer 402 is fluidically downstream and in fluid communication with the heat exchanger 104 and the partial state condenser 108.

The pressure balancer 402 may include an overflow reservoir 404 and an overflow controller 406. The overflow reservoir 404 includes a reservoir inlet valve 408 upstream of the overflow reservoir 404 and an outlet valve 410 fluidically downstream of the overflow reservoir 404. The reservoir inlet valve 408 and the reservoir outlet valve 410 manage mass of the working fluid in the heat engine system 100 to maintain a constant pressure at a pressure sense point.

The pressure is measured at the pressure sense point by a pressure sensor 412 disposed at the pressure sense point. The pressure sense point is located upstream of and in fluid communication with the heat engine expander 106, such as at an inlet port of the heat engine expander 106. The overflow controller 406 controls the reservoir inlet valve 408 and the reservoir outlet valve 410 of the overflow reservoir 404 to maintain a predetermined pressure value at the pressure sense point.

Figure 5:
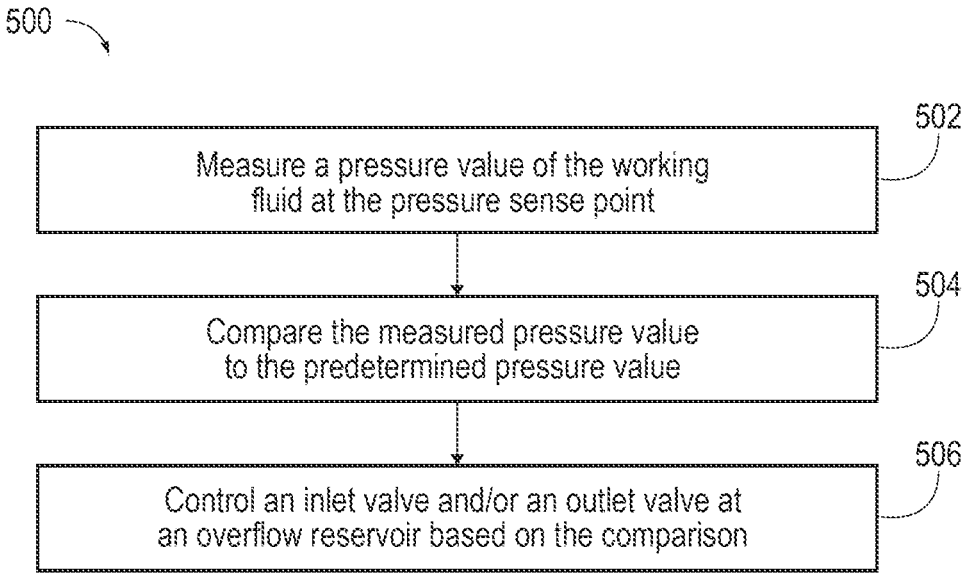
FIG. 5 is an exemplary process flow of a method for operation of a pressure balancer for a heat engine system, according to one embodiment.

FIG. 5 is an exemplary process flow of a method for operation of the pressure balancer 402 for an imbalanced heat engine, according to one embodiment. FIG. 5 will be described with reference to FIGS. 1-4 and 6-10. For simplicity, the method 500 will be described as a sequence of blocks, but it is understood that the blocks of the method 500 may be organized into different architectures, elements, stages, and/or processes.

At block 502, the method 500 includes the overflow module 224 determining a pressure value of the working fluid at a pressure sense point. The pressure is measured by the pressure sensor 412 at the pressure sense point. At block 504, the method 500 includes the overflow module 224 comparing the measured pressure value to a predetermined pressure value. At block 506, the method 500 includes the overflow module 224 controlling a reservoir inlet valve 408 and/or a reservoir outlet valve 410 at the overflow reservoir 404 based on the comparison. The overflow module 224 may control the reservoir inlet valve 408 or the reservoir outlet valve 410 using the overflow controller 406. The overflow controller 406 may be implemented by the execution module 228. The overflow controller 406 may be an analog circuit or implemented in a computer environment, such as the computing environment 200 of FIG. 2. The overflow controller 406 may be the computing device 204 and/or the operational systems 206.

If the measured pressure at the pressure sense point matches the predetermined pressure value, the overflow controller 406 may cause both the reservoir inlet valve 408 and reservoir outlet valve 410 to be closed. If the measured pressure value at the pressure sense point is above the predetermined pressure value, the overflow controller 406 may cause the reservoir inlet valve 408 to be opened proportional to the amount that the measured pressure value is above the predetermined pressure value, thereby allowing some of the pressure developed by the heat engine compressor 102 to force the working fluid into overflow reservoir 404 and remove it from circulation in the cycle. This effectively reduces the pressure at the sense point. If the measured pressure value at the pressure sense point is above the predetermined pressure value, the overflow controller 406 causes the reservoir outlet valve 410 to remain closed.

If the measured pressure value at the pressure sense point is below the predetermined pressure value, the overflow controller 406 may cause the reservoir outlet valve 410 to be opened proportionally to the amount under the predetermined pressure value, enabling more working fluid into circulation and raising the pressure at the sense point. The overflow controller 406 may cause the reservoir outlet valve 410 to be opened proportional to the amount that the pressure value is below the predetermined pressure value. Also, if the pressure value at the pressure sense point is below the predetermined pressure value, the overflow controller 406 causes the reservoir inlet valve 408 to remain closed. By regulating precise pressure operating points at sense points, such as a temperature sense point, pressure sense point, or the inlet of the heat engine expander 106, the heat engine expander 106 can be optimized for high-efficiency energy conversion without variations in the ambient environment or resulting from small fluid leaks.

B. An Imbalanced Heat Engine Having a Heat Pump

In one embodiment, the imbalanced heat engine system 600 with a heat pump 602, the imbalanced heat engine system 600 can continuously take in energy in the form of low-grade heat via the heat pump 602. This may not only power the heat pump 602 and the imbalanced heat engine system 600, but also generate work output. This innovation can be applied to many industries to support electrification and continuous renewable electricity generation.

Figure 6:
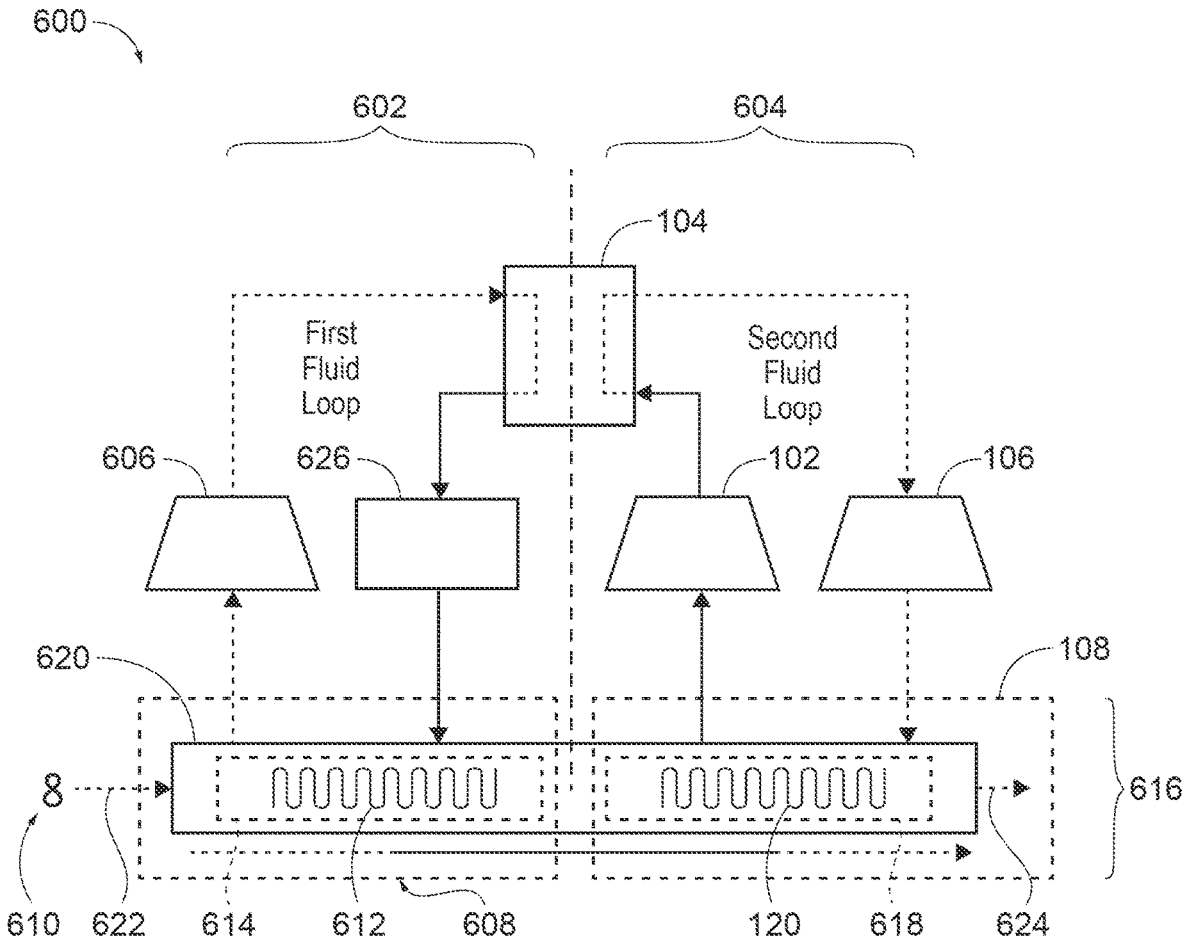
FIG. 6 is an exemplary component diagram for an operating environment of an imbalanced heat engine system with a heat pump, according to one embodiment.

Referring to FIG. 6, an imbalanced heat engine system 600 is an alternate embodiment of the heat engine system 100 of FIG. 1. The imbalanced heat engine system 600 includes a heat pump 602 in addition to the imbalanced heat engine 604. In the embodiment of FIG. 6, like elements with the heat engine system 100 of FIG. 1 are denoted with the same reference numerals and operate in a similar manner as described above.

The heat pump 602 includes a heat pump compressor 606. The heat pump compressor 606 circulates working fluid through a first fluid loop in the imbalanced heat engine system 600. The heat pump compressor 606, like the heat engine compressor 102, may, for example, be a positive displacement compressor or a dynamic compressor. In an embodiment in which the heat pump compressor 606 is a positive displacement compressor, the heat pump compressor 606 may increase the pressure of the working fluid by reducing the volume of the working fluid with, for example, a piston, rotary vane, etc. In an embodiment in which the heat pump compressor 606 is a dynamic compressor, the heat pump compressor 606 may increase the pressure of the working fluid with a continuous transfer of angular momentum to the working fluid with, for example, a rotating member. In some embodiments, the heat pump compressor 606 may be a two-phase compressor.

The first fluid loop also includes the heat exchanger 104 downstream and in fluid communication with both the metering device 626 and the heat pump compressor 606. The heat exchanger 104 transfers energy from the heat pump 602 to the heat engine 604. For example, suppose the heat engine compressor 102, the heat exchanger 104, the heat engine expander 106, and the partial state condenser 108 form a second fluid loop. Then, in the first fluid loop, the heat exchanger 104 receives the working fluid in an energized state (e.g., vapor state, saturated state, etc.) from the heat pump compressor 606. The heat exchanger 104 receives the working fluid in a recovery state (i.e., liquid state, saturated state, etc.) from the second fluid loop. The heat exchanger 104 then transfers energy from the first fluid loop to the second fluid loop but does not transfer any working fluid.

The heat pump 602 also includes a heat pump evaporator 608. The heat pump evaporator 608 is downstream and in fluid communication with the metering device 626 and the heat pump compressor 606. The heat pump evaporator 608 includes a fan 610 and at least one set of evaporator coils 612. The fan 610 is configured to generate an airflow toward the at least one set of evaporator coils 612. In one embodiment, a first airflow zone 614 is immediately adjacent the second airflow zone 618. The at least one set of evaporator coils 612 is configured to carry the working fluid through the first airflow zone 614 in the first fluid loop transferring heat in the process.

In some embodiments, the heat pump evaporator 608 and the partial state condenser 108 may be coupled to form an evaporator condenser pair 616. The evaporator condenser pair 616 may include the fan 610, at least one set of evaporator coils 612, and the at least one set of condenser coils 120. The at least one set of condenser coils 120 are included in a second airflow zone 618. The first airflow zone 614 is fluidically disposed between the fan 610 and the second airflow zone 618. Thus, the airflow generated by the fan 610 is communicated through the first airflow zone 614 and subsequently communicated to the second airflow zone 618.

In one embodiment, the first airflow zone 614 and the second airflow zone 618 are disposed in a chamber 620 that receives the airflow from the fan 610. The chamber 620 may form a tunnel extending between a chamber inlet 622 and a chamber outlet 624. The chamber inlet 622 is immediately adjacent the fan 610 and receives the airflow generated by the fan 610. The chamber outlet 624 is immediately adjacent the second airflow zone 618. The chamber outlet 624 allows the airflow to exit the chamber 620 so that the airflow moves in a single longitudinal direction with respect to the chamber 620.

A metering device 626 may be interposed between and in fluid communication with the heat exchanger 104 and the heat pump evaporator 608 or the evaporator condenser pair 616. The metering device 626 serves as an isenthalpic pressure reducer to enable the working fluid in an energized state (e.g., heated, saturated state, vapor state, etc.) coming from the heat exchanger 104 to move to a recovery state. The metering device 626 may be a variable flow-rate valve that regulates the amount of the working fluid flowing through the at least one set of evaporator coils 612 so that the working fluid is converted to gas state before entering the heat pump compressor 606. In one embodiment, the metering device 626 may be a thermal expansion valve (TXV).

Figure 7:
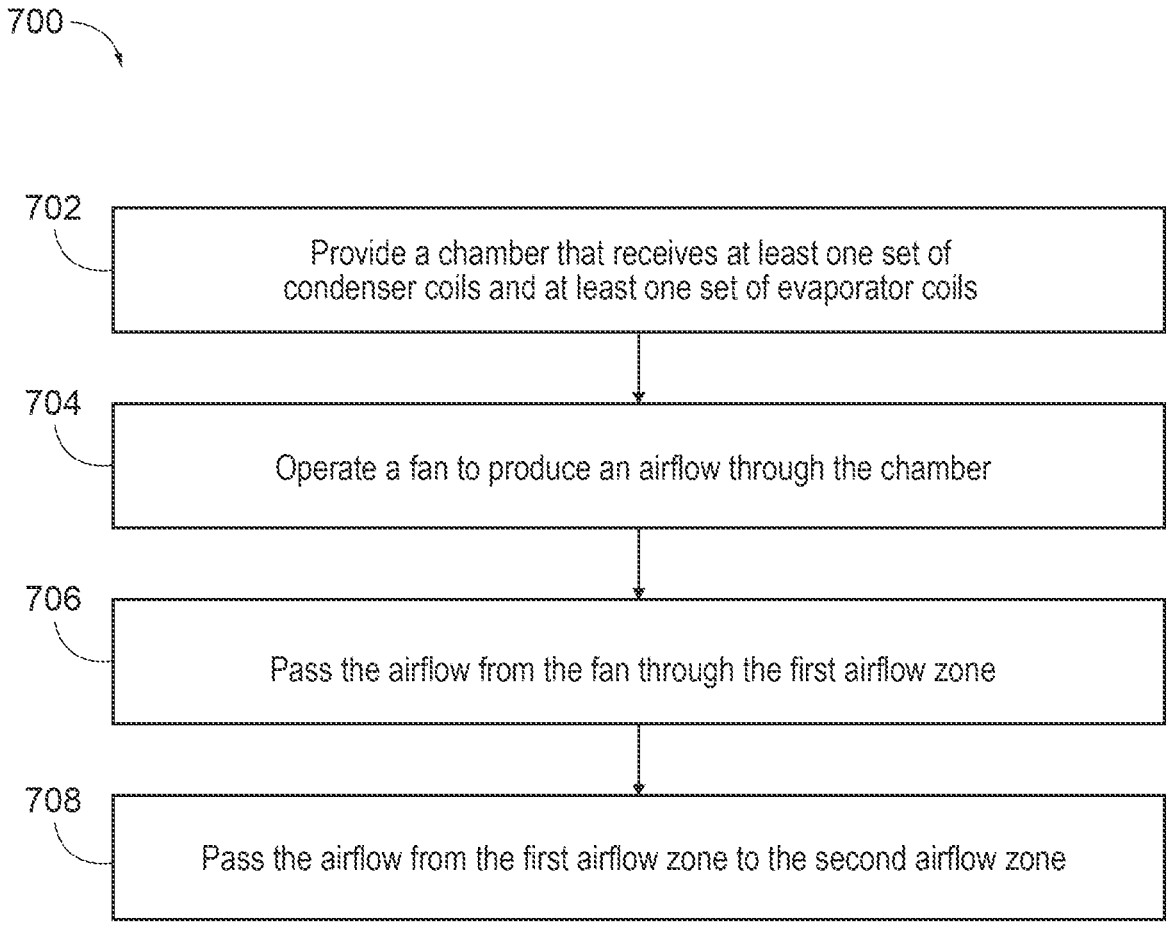
FIG. 7 is an exemplary process flow of a method for operation of an imbalanced heat engine with a heat pump, according to one embodiment.

FIG. 7 is an exemplary process flow of a method for operation of an imbalanced heat engine system 600 with the heat pump 602, according to one embodiment. FIG. 7 will also be described with reference to FIGS. 1-6, 8, and 9. For simplicity, the method 700 will be described as a sequence of blocks, but it is understood that the blocks of the method 700 may be organized into different architectures, elements, stages, and/or processes.

At block 702 the method 700 includes providing a chamber 620 that receives at least one set of condenser coils 120 and also at least one set of evaporator coils 612. The at least one set of evaporator coils 612 is disposed in a first airflow zone 614 of the chamber 620 and the at least one set of condenser coils 120 is disposed in a second airflow zone 618 of the chamber 620. The first airflow zone 614 and the second airflow zone 618 are in fluid communication with one another.

At block 704 the method 700 includes operating the fan 610 to produce an airflow through the chamber 620. The fan 610 may be controlled based on fan speed, motor torque, aerodynamic properties of the fan 610 and the chamber, etc.

At block 706 the method 700 includes passing the airflow from the fan 610 through the first airflow zone 614. The first airflow zone 614 includes the at least one set of evaporator coils 612. The first airflow zone 614 included in the first fluid loop for a first working fluid.

At block 708 the method 700 includes passing the airflow from the first airflow zone 614 to the second airflow zone 618. The second airflow zone 618 includes the at least one set of condenser coils 120. The second airflow zone 618 is included in the second fluid loop for a second working fluid. The second fluid loop is fluidically isolated from the first fluid loop. In some embodiments, the first working fluid and the second working fluid may be the same working fluid. In another embodiment, the first working fluid and the second working fluid may be different working fluids.

Figure 8:
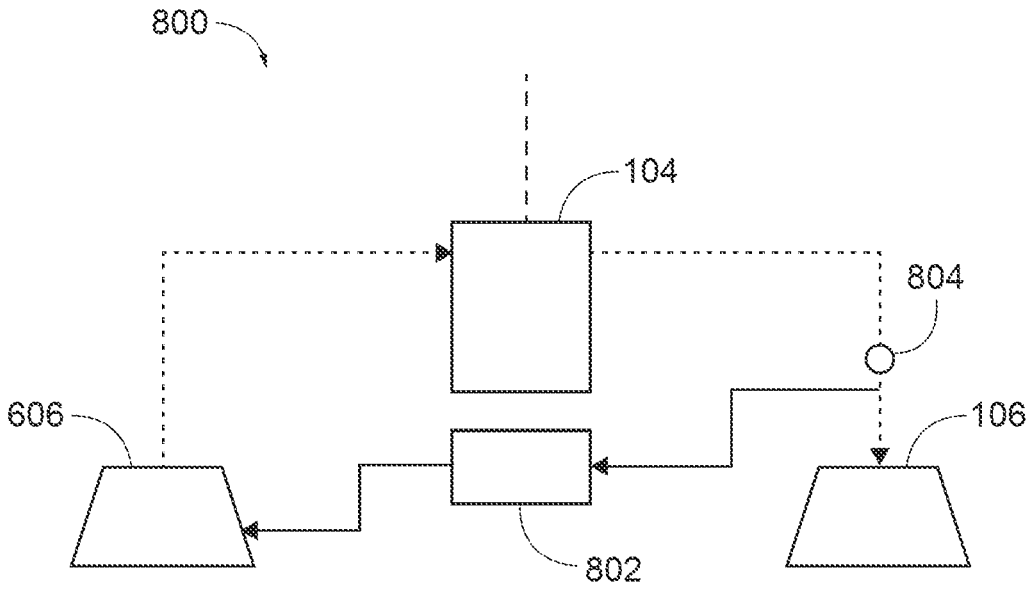
FIG. 8 is an exemplary component diagram of an imbalanced system heat engine system with a heat pump compressor controller, according to one embodiment.

FIG. 8 is an exemplary component diagram for a heat pump compressor controller, according to one embodiment. To regulate the state of the fluid entering the heat engine expander 106, the energy capacity of the heat pump 602 may be regulated. For example, too little energy, and the heat engine expander 106 may be pushed outside its optimal efficiency range resulting in less overall energy output. Too much energy, and excess amounts of work may be needed to transition the energy through the imbalanced heat engine system 600. With a constant pressure at the heat engine expander inlet port of the heat engine expander 106, the energy of the working fluid can be determined by measuring the temperature of the working fluid at the heat engine expander inlet port of the heat engine expander 106. The heat pump compressor 606 can then be modified to increase or decrease the energy capacity of the heat pump 602.

The heat capacity module 226 may control the heat capacity of the heat pump compressor 606 with a heat capacity controller 802. The heat capacity controller 802 may be implemented by the execution module 228. The heat capacity controller 802 may be an analog circuit or implemented in a computer environment, such as the computing environment 200 of FIG. 2. The heat capacity controller 802 may be the computing device 204 and/or the operational systems 206.

The temperature is measured at a temperature sense point by a temperature sensor 804 disposed at the temperature sense point. The temperature sense point is located upstream of and in fluid communication with the heat engine expander 106, such as at the heat engine expander inlet port of the heat engine expander 106. The heat capacity controller 802, in some embodiments, controls the rotational speed of the heat pump compressor 606 to maintain a predetermined temperature value at the temperature sense point. In one embodiment, the temperature sensor 804 may be implemented with the pressure sensor 412 disposed at the temperature sense point. Accordingly, the temperature sense point and the pressure sense point may be the same point located upstream of and in fluid communication with the heat engine expander 106, such as at a heat engine expander inlet port of the heat engine expander 106.

Figure 9:
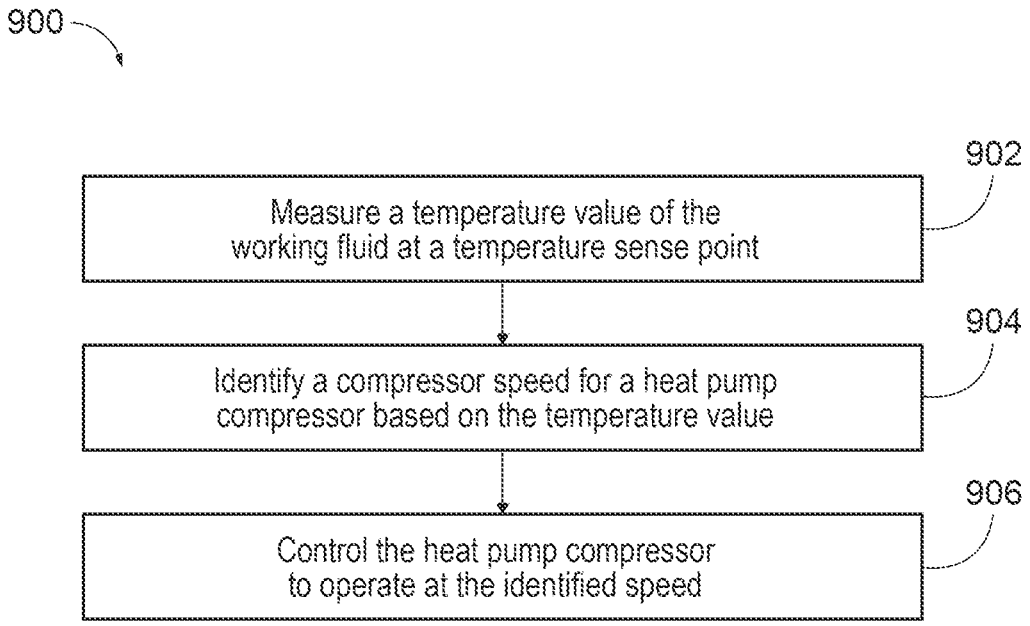
FIG. 9 is an exemplary process flow of a method for operation of a heat pump compressor controller, according to one embodiment.

FIG. 9 is an exemplary process flow of a method for operation of a heat pump compressor controller, according to one embodiment. FIG. 9 will also be described with reference to FIGS. 1-8, and 10. For simplicity, the method 900 will be described as a sequence of blocks, but it is understood that the blocks of the method 900 may be organized into different architectures, elements, stages, and/or processes.

At block 902 the method 900 includes measuring a temperature value of the working fluid at an inlet port of the heat engine expander 106. The temperature is measured at a temperature sense point by a temperature sensor 804. The temperature may be received as sensor data 210.

At block 904 the method 900 includes identifying a heat capacity for a heat pump compressor 606. In one embodiment, the heat pump compressor 606 is a variable speed compressor that may modify the rotational speed of operation of the heat pump compressor 606. The heat capacity of the heat pump compressor 606 may be proportional to the rotational speed of the heat pump compressor 606. In some embodiments, the rotational speed may be identified based on a look-up table. The rotational speed may be identified based on the measured temperature of the working fluid and the type of the working fluid.

At block 906 the method 900 includes controlling the heat pump compressor 606 to operate at the identified heat capacity. The method 900 includes the heat capacity module 226 controlling the heat pump compressor 606 based on the identified heat capacity. The heat capacity controller 802 may be implemented by the execution module 228. The heat capacity controller 802 may be an analog circuit or implemented in a computer environment, such as the computing environment 200 of FIG. 2. The heat capacity controller 802 may be the computing device 204 and/or the operational systems 206.

Figure 10:
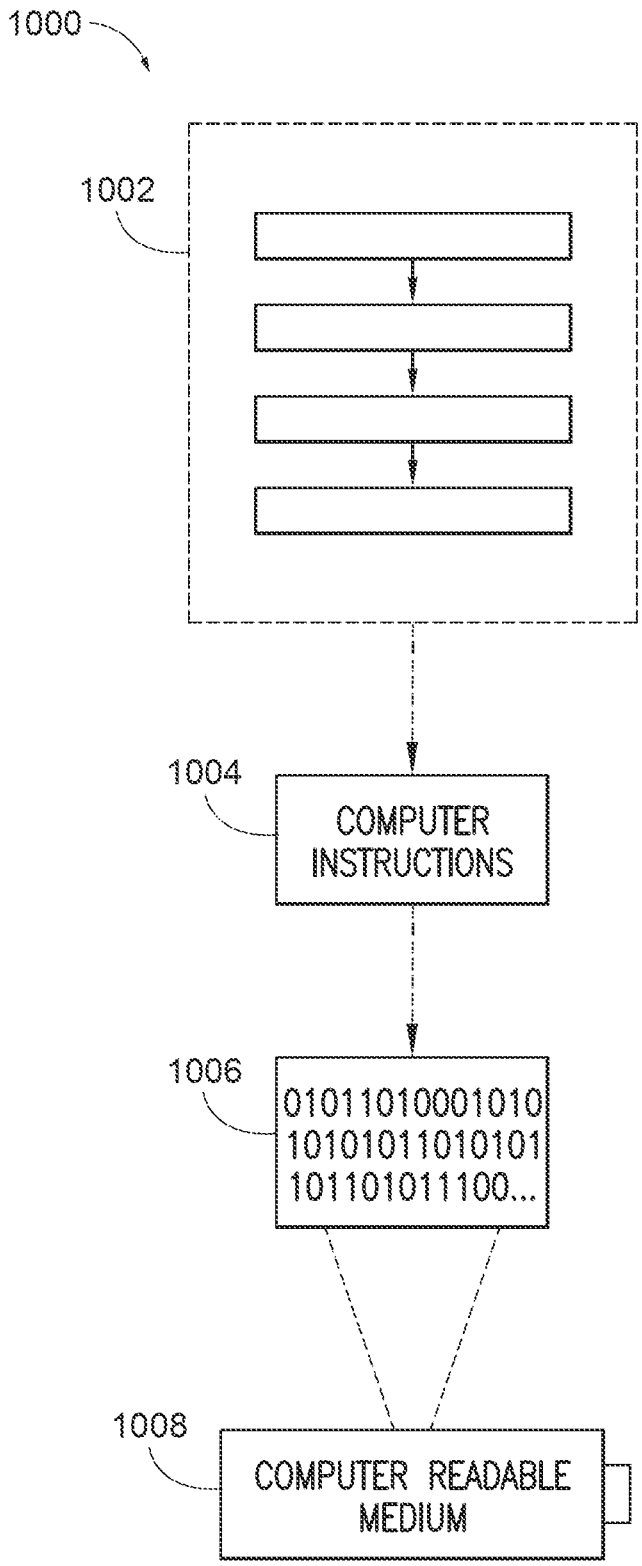
FIG. 10 is an illustration of an example computer-readable medium or computer-readable device including processor-executable instructions configured to embody one or more of the provisions set forth herein, according to one aspect.

Still another aspect involves a computer-readable medium including processor-executable instructions configured to implement one aspect of the techniques presented herein. An aspect of a computer-readable medium or a computer-readable device devised in these ways is illustrated in FIG. 10, wherein an implementation 1000 includes a computer-readable medium 1008, such as a CD-R, DVD-R, flash drive, a platter of a hard disk drive, etc., on which is encoded computer-readable data 1006. This encoded computer-readable data 1006, such as binary data including a plurality of zero's and one's as shown in 1006, in turn includes a set of processor-executable computer instructions 1004 configured to operate according to one or more of the principles set forth herein.

In this implementation 1000, the processor-executable computer instructions 1004 may be configured to perform a method 1002, such as the method 300 of FIG. 3, the method 500 of FIG. 5, the method 700 of FIG. 7, and/or the method 900 of FIG. 9. In another aspect, the processor-executable computer instructions 1004 may be configured to implement a system, such as the computing environment 200 of FIG. 2. Many such computer-readable media may be devised by those of ordinary skill in the art that are configured to operate in accordance with the techniques presented herein.

As used in this application, the terms "component", "module," "system", "interface", and the like are generally intended to refer to a computer-related entity, either hardware, a combination of hardware and software, software, or software in execution. For example, a component may be, but is not limited to being, a process running on a processor, a processing unit, an object, an executable, a thread of execution, a program, or a computer. By way of illustration, both an application running on a controller and the controller may be a component. One or more components residing within a process or thread of execution and a component may be localized on one computer or distributed between two or more computers.

Further, the claimed subject matter is implemented as a method, apparatus, or article of manufacture using standard programming or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Although the subject matter has been described in language specific to structural features or methodological acts, it is to be understood that the subject matter of the appended claims is not necessarily limited to the specific features or acts described above. Rather, the specific features and acts described above are disclosed as example aspects. Various operations of aspects are provided herein. The order in which one or more or all of the operations are described should not be construed as to imply that these operations are necessarily order dependent. Alternative ordering will be appreciated based on this description. Further, not all operations may necessarily be present in each aspect provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

It will be appreciated that several of the above-disclosed and other features and functions, or alternatives or varieties thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A heat engine system, the heat engine system comprising:

a heat engine compressor that circulates a working fluid through the heat engine system;

a heat exchanger fluidically downstream from and in fluid communication with the heat engine compressor;

a heat engine expander fluidically downstream from and in fluid communication with the heat exchanger, the heat engine expander including a heat engine expander inlet port; and a partial state condenser fluidically downstream from and in fluid communication with the heat engine expander, the partial state condenser including:

a sense reservoir that holds the working fluid;

a reservoir sensor that senses an electrical property of the working fluid;

a reservoir valve that is a three-way valve in fluid communication with the sense reservoir, the heat engine compressor, and a heat engine condenser; and a processor configured to execute instructions to:

determine a specific energy of the working fluid based on the electrical property of the working fluid; and control the reservoir valve based on the specific energy of the working fluid to maintain a two-phase saturated state point within the partial state condenser based on the electrical property.

2. The heat engine system of claim 1, wherein the reservoir valve causes the working fluid to be selectively passed to the heat engine condenser to maintain a controlled saturation state that is above ambient pressure in the partial state condenser.

3. The heat engine system of claim 1, wherein the heat engine compressor is a two-phase compressor.

4. The heat engine system of claim 1, wherein the electrical property is relative dielectric permittivity.

5. The heat engine system of claim 1, wherein the heat engine expander includes a number of surfaces in contact with the working fluid, and wherein the number of surfaces is coated with a thermally insulative coating to reduce heat conduction.

6. The heat engine system of claim 1, further comprising: a pressure balancer in fluid communication with the heat exchanger and the partial state condenser and in parallel with the heat engine compressor, the pressure balancer including: an overflow reservoir, a reservoir inlet valve fluidically upstream of the overflow reservoir and a reservoir outlet valve fluidically downstream of the overflow reservoir; and an overflow controller that controls the reservoir inlet valve and the reservoir outlet valve to maintain a predetermined pressure value at a sense point at an inlet port of the heat engine expander.

7. The heat engine system of claim 1, wherein the heat exchanger is in fluid communication with a heat pump.

8. The heat engine system of claim 7, wherein the heat pump comprises: a heat pump evaporator; and a heat pump compressor in fluid communication with and fluidically downstream of the heat pump evaporator.

9. The heat engine system of claim 8, wherein the heat pump evaporator is in fluid communication with the partial state condenser.

10. The heat engine system of claim 8, wherein a metering device that is in fluid communication with and fluidically downstream of the heat exchanger, wherein the metering device is a variable flow-rate valve that regulates an amount of the working fluid flowing from the heat exchanger to the heat pump evaporator.

11. The heat engine system of claim 8, further comprising: a heat pump compressor controller that controls a heat capacity of the heat pump compressor based on a temperature of the working fluid at the heat engine expander inlet port of the heat engine expander.

12. A heat engine system, the heat engine system comprising:

a heat engine compressor that circulates a working fluid through the heat engine system;

a heat exchanger fluidically downstream from and in fluid communication with the heat engine compressor;

a heat engine expander fluidically downstream from and in fluid communication with the heat exchanger, the heat engine expander including a heat engine expander inlet port; and a partial state condenser fluidically downstream from and in fluid communication with the heat engine expander, the partial state condenser including:

a sense reservoir that holds the working fluid;

a reservoir sensor that senses an electrical property of the working fluid;

a reservoir valve that is a three-way valve in fluid communication with the sense reservoir, the heat engine compressor, and a heat engine condenser; and a processor configured to execute instructions to:

determine a vapor quality of the working fluid based on the electrical property of the working fluid;

determine a specific energy in the sense reservoir based on the vapor quality of the working fluid; and control the reservoir valve to cause the working fluid to be selectively passed to the heat engine condenser based on the specific energy to maintain a controlled saturation state that is different than an ambient pressure in the partial state condenser.

13. The heat engine system of claim 12, wherein the heat engine compressor is a two-phase compressor.

14. The heat engine system of claim 12, wherein the electrical property is relative dielectric permittivity.

15. The heat engine system of claim 12, wherein the heat engine expander includes a number of surfaces in contact with the working fluid, and wherein the number of surfaces are coated with a thermally insulative coating to reduce heat conduction.

16. The heat engine system of claim 12, further comprising: a pressure balancer in fluid communication with the heat exchanger and the partial state condenser and in parallel with the heat engine compressor, the pressure balancer including: an overflow reservoir having a reservoir inlet valve fluidically upstream of the overflow reservoir, and a reservoir outlet valve fluidically downstream of the overflow reservoir; and an overflow controller configured to control the reservoir inlet valve and reservoir outlet valve to maintain pressure at a sense point at the heat engine expander inlet port of the heat engine expander.

17. A method for a heat engine system, the method comprising:

providing a chamber that receives at least one set of condenser coils and at least one set of evaporator coils such that the at least one set of evaporator coils is disposed in a first airflow zone of the chamber and the at least one set of condenser coils is disposed in a second airflow zone of the chamber, the first airflow zone and the second airflow zone being in fluid communication with one another;

operating a fan to produce an airflow through the chamber;

passing the airflow from the fan through the first airflow zone, wherein the at least one set of evaporator coils defines a first fluid loop for a first working fluid;

passing the airflow from the first airflow zone to the second airflow zone, wherein the at least one set of condenser coils defines a second fluid loop for a second working fluid, the second fluid loop being fluidically isolated from the first fluid loop, wherein the at least one set of condenser coils is fluidically downstream of and in fluid communication with a reservoir valve, the reservoir valve being in fluid communication with a sense reservoir;

wherein the method further comprises:

determining a specific enemy of a working fluid in the sense reservoir in the second fluid loop based on an electrical property of the working fluid; and controlling the reservoir valve to move the working fluid to the at least one set of condenser coils based on the determined specific energy of the working fluid.

18. The method for the heat engine system of claim 17, wherein the specific energy is based on a mass of the working fluid in a vapor state to a total mass of the working fluid.

19. The method for the heat engine system of claim 17, wherein the electrical property is relative dielectric permittivity.

* * * * *